US007572098B1

(12) United States Patent
Johnson

(10) Patent No.: US 7,572,098 B1
(45) Date of Patent: Aug. 11, 2009

(54) VANE RING WITH A DAMPER

(76) Inventor: Gabriel L. Johnson, 507 SE. Whitmore Dr., Port St. Lucie, FL (US) 34984

( * ) Notice: Subject to any disclaimer, the term of this patent is extended or adjusted under 35 U.S.C. 154(b) by 477 days.

(21) Appl. No.: 11/545,860

(22) Filed: Oct. 10, 2006

(51) Int. Cl.
*F01D 5/26* (2006.01)

(52) U.S. Cl. ..... 415/119; 415/199.1; 415/208.1

(58) Field of Classification Search ..... 415/119, 415/208.2, 209.1, 209.4, 210.1; 416/190, 416/500
See application file for complete search history.

(56) References Cited

U.S. PATENT DOCUMENTS 1,554,614 A * 9/1925 Allen ..... 416/190
2,310,412 A 2/1943 Flanders
2,942,843 A 6/1960 Sampson
3,728,041 A 4/1973 Bertelson
3,752,599 A 8/1973 Pace
3,754,839 A * 8/1973 Bodman ..... 416/195
4,111,603 A * 9/1978 Stahl ..... 416/95
4,497,611 A 2/1985 Keller
4,986,737 A 1/1991 Erdmann
5,156,528 A * 10/1992 Bobo ..... 416/190
5,197,856 A * 3/1993 Koertge et al. ..... 415/209.3
5,201,850 A * 4/1993 Lenhardt et al. ..... 416/190
5,215,432 A 6/1993 Pickering et al.
5,429,477 A 7/1995 Sikorski et al.
6,969,239 B2 11/2005 Grant et al.

* cited by examiner

*Primary Examiner*—Igor Kershteyn
(74) *Attorney, Agent, or Firm*—John Ryznic

(57) ABSTRACT

A vane ring damper for a small turbomachine, the vane ring having a plurality of vanes extending between an inner ring and an outer ring and forming a gas flow path, where one of the inner and the outer rings have cuts formed between adjacent vanes to form separate ring segments. In one embodiment, a frictional damper is positioned between the ring segments to provide frictional damping for the vane assembly. in another embodiment, the cuts are formed at about a 45 degree angle and the space is narrow such that adjacent segments rub during vibration and provide the frictional damping for the vane assembly. Inner or outer bands are used to secure the ring segments together and to hold the frictional damper within the space formed between adjacent ring segments. Cuts can be formed between every vane to form a ring segment for each vane, or cuts can be formed in an alternating series such that two or more adjacent vanes extend from a common ring segment.

11 Claims, 2 Drawing Sheets

VANE RING WITH A DAMPER

BACKGROUND OF THE INVENTION

1. Field of the Invention

The present invention relates generally to rotary kinetic fluid motors or pumps, and more specifically to stator vanes in a compressor of a small turbomachine and, in particular, to the damping of vibrations transmitted to such stator vanes from the casing of the turbomachine.

2. Description of the Related Art Including Information Disclosed Under 37 CFR 1.97 and 1.98

A turbomachine, such as a compressor in a gas turbine engine, includes a plurality of stages of rotor blades to compress the air and a plurality of stages of guide vanes or nozzles that act to guide the airflow into the rotor blades. The compressor is subject to vibration stresses and fatigue from rotor imbalances and pressure differentials within the gas turbine engine, as well as from others. The vibrations can be so severe that the lifetime of the compressor or casing, or the rotor blades and stator vanes, can be damaged. Excessive wear or part damage can occur from rubbing between vibrating engine parts. These rubs are undesirable due to wear gaps, which can decrease engine performance, that are created between the rubbing parts. Therefore, because close tolerances between engine parts are required for good engine performance, minimization of engine vibration is desirable.

Vibrations are of greatest concern when the resonance frequency of the engine component part lies within the frequency range of the vibrations expected to occur during normal engine operations. Rotor blades and stator vanes are subject to nodal diameter vibration, a form of vibration characterized by two (or more in higher vibration modes) nodes on the circumference of the component part remaining stationary while parts there-between oscillate. In small turbomachine, the stator ring is typically cast as a single small piece. Because of the size, it is not economical to produce a multiple vane stator ring since the individual vanes could be as small as ½ inch in length.

It is an object of the present invention to reduce vibrations in a stator vane ring of a small turbomachine.

BRIEF SUMMARY OF THE INVENTION

A stator ring for a small turbomachine is made of a single piece with a plurality of vanes extending between an inner shroud ring and an outer shroud ring with the vanes connected between the inner and outer shroud rings. Adjacent vanes have a cut formed through either the inner ring or the outer ring, with a frictional damper held within the cut section by an annular outer band. The outer band holds the frictional damper between the adjacent shroud rings and function to dampen any vibrations. In another embodiment, no frictional damper is used but the cut between adjacent shroud rings is made narrow such that frictional rubbing of adjacent shroud ring ends function to dampen the vibrations.

A solid vane ring can be cast as a single piece, and then the cuts made in the shroud rings to provide for the damping effect. An outer band or an inner band is then placed over the shroud ring segments and the cut to hold the shroud ring segments together and the frictional damper if used.

DETAILED DESCRIPTION OF THE INVENTION

Figure 1:
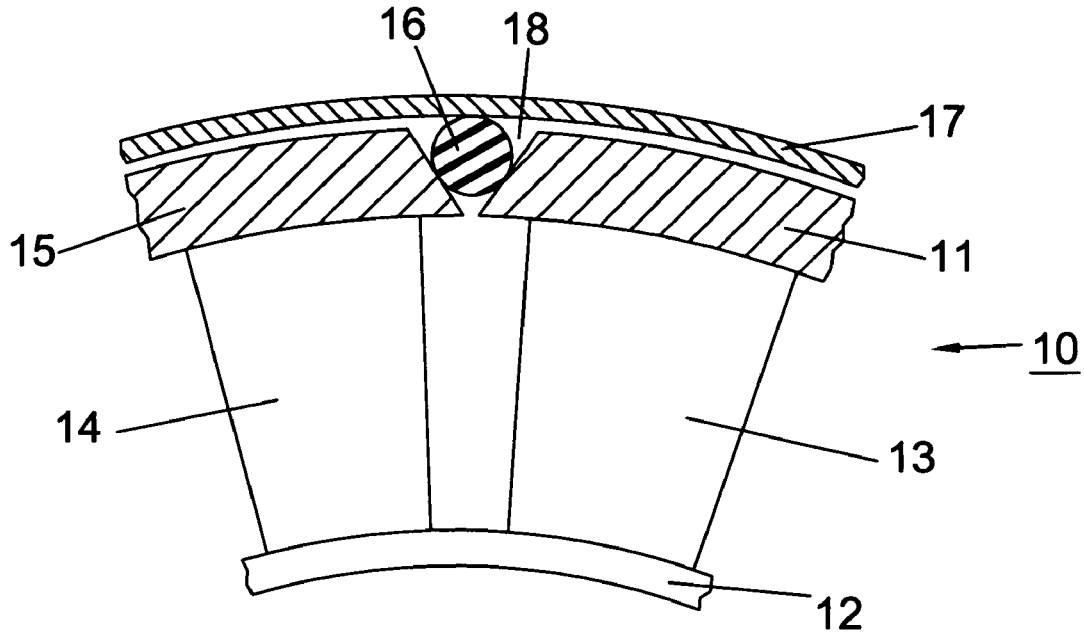
FIG. 1 shows a front view of two adjacent vanes in a vane ring with a frictional damper secured within a cut and held in place by an outer band.

A turbomachine, such as a compressor in a gas turbine engine, includes a stator vane ring assembly with a plurality of vanes extending from an outer ring shroud to and inner ring shroud, the vanes formed in an annular ring and function to guide the air into the rotor blades of the turbomachine. FIG. 1 shows a first embodiment of the present invention from the front view. Only two of the vanes are shown in FIG. 1 for simplicity. The vane ring is a full annular ring with vanes extending around the circumference. The vane ring assembly 10 includes a first vane 13 extending between an inner shroud ring 12 and an outer shroud ring segment 11. A second and adjacent vane 14 extends between the inner ring 12 and an outer ring 15 segment. A cut is made between the outer ring of the vane ring assembly to form a space 18 between outer ring segments 11 and 15. In this embodiment, the cut is made to form a V-shaped space. A frictional damper 16 in the shape of a solid tube is secured within the space 18 by an outer band 17. The outer band 17 functions to seal the outer ring segments and to hold the outer ring segments 11 and 15 together due to the cut made. The frictional damper can be made of any material (such as a plastic resin) that would convert the vibrations into friction by relative movements of the ring segments 11 and 15 and the frictional damper 16.

Figure 2:
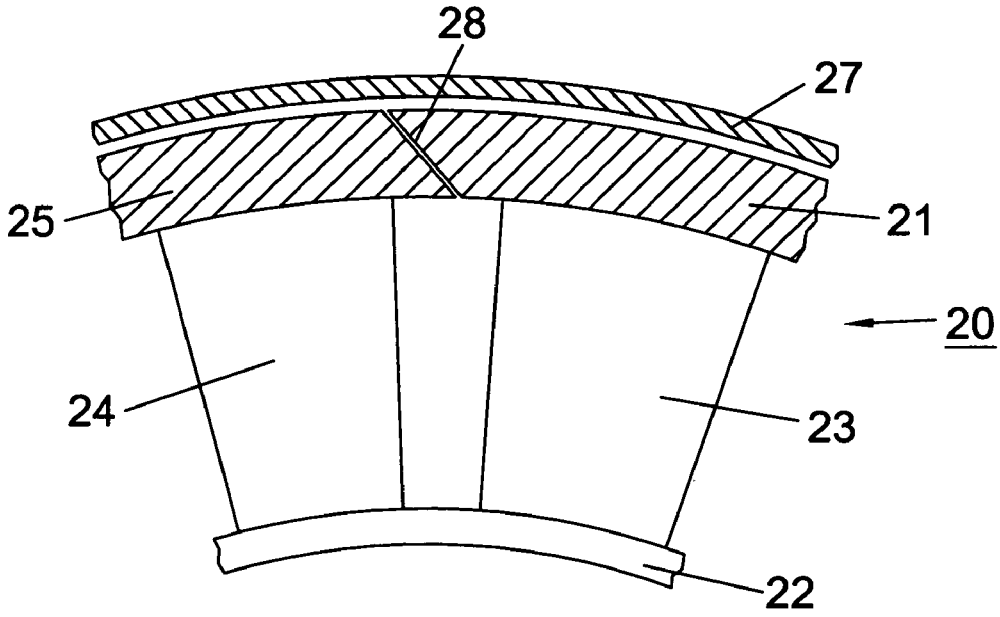
FIG. 2 shows a front view of a second embodiment of the vane ring damper.

In a second embodiment of the vane ring assembly 20 shown in FIG. 2, a cut 28 is made in the outer ring to form the outer ring segments 21 and 25. In the FIG. 2 embodiment, the cut 28 is made such that the segment ends will rub against each other and produce the frictional rubbing to dampen the vibrations. The two vanes 23 and 24 extend from a single inner ring 22 as in the FIG. 1 embodiment. The cut is shown in FIG. 2 to be at about 45 degrees from the radial direction of the vane assembly. Other angles of the cut could be used depending upon the damping characteristics that would result. The cut is made to that the space between adjacent ring segments is small enough to allow for rubbing of the segment ends during vibration of the vane ring assembly 20. An outer band 27 is used seal the inner ring segments and to hold the ring segments 21 and 25 of the vane ring together.

Figure 3:
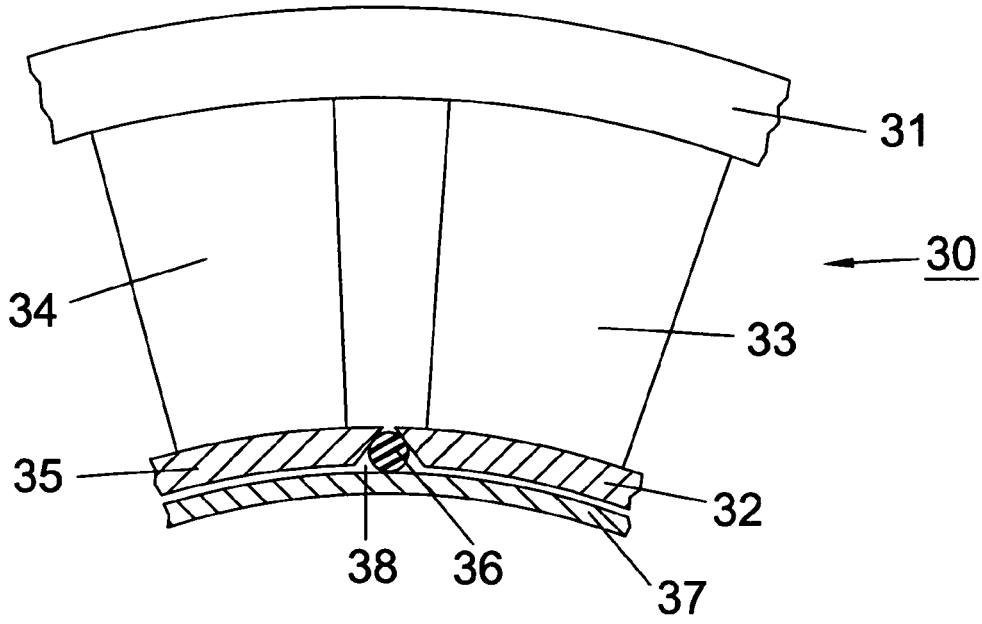
FIG. 3 shows a front view of a third embodiment of the vane ring damper.

A third embodiment of the vane ring assembly 30 is shown in FIG. 3. The vane ring assembly 30 includes a first vane 33 and a second vane 34 extending from an outer ring shroud 31. The inner ring is cut to form two inner ring segments 32 and 35 with a space 38 formed between adjacent ends of the segments. The cut has an inverted V-shape, and a frictional damper 36 is secured within the space formed. An inner band 37 is used to hold the inner ring segments 32 and 35 together and hold the frictional damper 36 within the space. The third embodiment of FIG. 3 operates like the first embodiment of FIG. 1. vibrations between adjacent inner rings segments 32 and 35 causes rubbing of the segment ends against the frictional damper 36 to provide damping from the vibrations.

Figure 4:
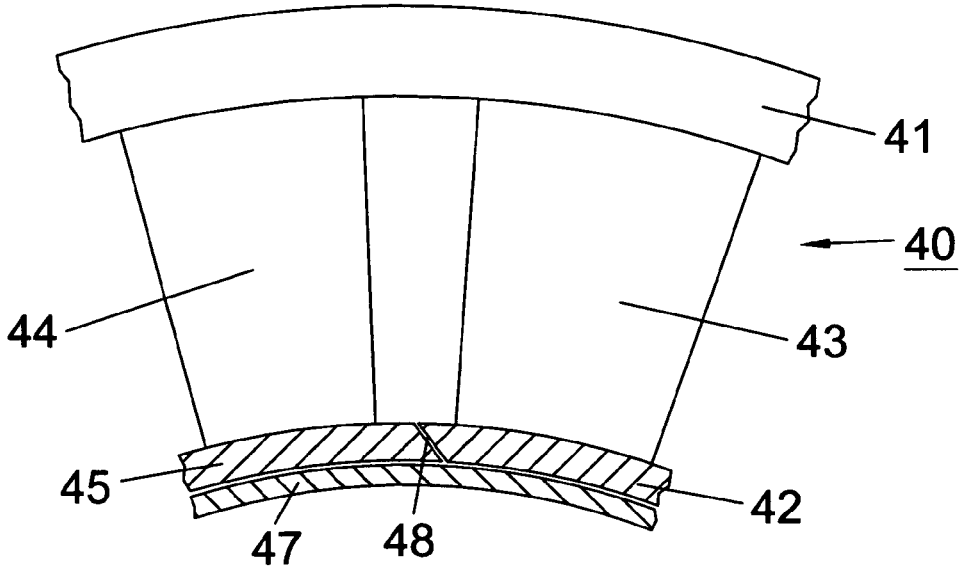
FIG. 4 shows a front view of a fourth embodiment of the vane ring damper.

A fourth embodiment of the present invention is shown in FIG. 4. The vane ring assembly 40 includes a first vane 43 and a second vane 44 extending from an outer ring shroud 41. A cut 48 is made to form inner ring segments 42 and 45, and an inner band 47 is placed over the segments to hold them together. The cut 48 is similar to the cut 28 in the FIG. 2 embodiment but made on the inner ring. The cut 48 is angled at about 45 degrees from the radial direction and the space small enough to allow for the adjacent segments ends to rub from the vibrations. The frictional rubbing provides the vibration damping for the vane ring assembly 40.

To form the vane guide assembly of any of the four embodiments described above, a solid vane ring assembly with inner ring and out ring is cast. A cut is made between adjacent vanes in the chosen inner or outer ring to form ring segments. If the V-shaped cut is made, then space must be sized to fit a frictional damper. The inner or outer band is then fitted around the ring segments. In the case of the cuts being formed in the inner ring, the inner band will be placed from the inside surface and made to expand outward to provide support for the inner ring segments. Because the inner ring provides a flow surface for the air passing through the vanes, the inner band would be in the flow field if placed outward of the inner ring. A groove could be cut in order to mount an inner ring flush with the upper surface of the inner ring segments if desired. The top of the inner band and the top of the inner ring would form a flush surface for the air to pass through the vanes.

In the vane ring assembly, the cuts could be formed in the rings at every location between adjacent vanes, or in an alternating arrangement like in every other segment of adjacent vanes. For example, one set of adjacent vanes could have a cut formed within the ring while the adjacent vanes on either side would not have a cut such that the inner ring or the out ring is continuous between adjacent vanes. If a vane ring assembly has 32 vanes, then 32 cuts would be made to form 32 ring segments. If every other vane was cut, then only 16 ring segments would be formed with two vanes per ring segment.

I claim the following:

1. A stator vane ring assembly comprising:

an inner ring and an outer ring;

a plurality of stator vanes extending between the inner ring and the outer ring and forming a gas flow path;

a cut formed in one of the inner ring or the outer ring to form ring segments in adjacent stator vanes;

the cut is angled with respect to the radial direction of the vane ring assembly and forms a space between adjacent segments such that frictional damping occurs through rubbing of segment contact surfaces; and, an outer/inner band formed around the one of the inner and outer ring to hold the ring segments together.

2. The stator vane ring assembly of claim 1, and further comprising:

the stator ring assembly is a single piece.

3. The stator vane ring assembly of claim 1, and further comprising:

the cut is formed in the inner ring; and, the band in an inner band encircling the inner ring segments.

4. The stator vane ring assembly of claim 1, and further comprising:

the cut is formed in the outer ring; and, the band in an outer band encircling the outer ring segments.

5. The stator vane ring assembly of claim 1, and further comprising:

the cut is formed in all of the stator vanes such that each vane extends from a separate ring segment.

6. The stator vane ring assembly of claim 1, and further comprising:

the cut is formed in an alternating series of vanes such that two or more vanes extend from a common ring segment.

7. A stator vane ring assembly comprising:

an inner ring and an outer ring;

a plurality of stator vanes extending between the inner ring and the outer ring and forming a gas flow path;

a V-shaped cut formed in one of the inner ring or the outer ring;

the V-shaped cut opening in a direction away from the stator vanes;

a friction damper positioned within the V-shaped cut; and, an annular band secured to the inner/outer ring to force the friction damper against the two surfaces of the V-shaped cut so that damping of the stator vane ring will occur.

8. The stator vane ring assembly of claim 7, and further comprising:

a V-shaped the cut is formed in all of the stator vanes such that each vane extends from a separate ring segment.

9. The stator vane ring assembly of claim 7, and further comprising:

the V-shaped cut is formed in an alternating series of stator vanes such that two or more vanes extend from a common ring segment.

10. The stator vane ring assembly of claim 7, and further comprising:

The V-shaped cut is parallel to a rotational axis of the stator vane assembly.

11. The stator vane ring assembly of claim 7, and further comprising:

The V-shaped cut is angled at around 45 degrees from a radial direction of the stator vane assembly.

* * * * *